United States Patent [19]

Milano

[11] Patent Number: 4,949,961

[45] Date of Patent: Aug. 21, 1990

[54] GOLF BALL SETTER

[76] Inventor: Salvatore Milano, 69 Tapley Ave., Revere, Mass. 02151

[21] Appl. No.: 441,619

[22] Filed: Nov. 27, 1989

[51] Int. Cl.[5] ..... A63B 71/00

[52] U.S. Cl. ..... 273/32.5; 294/19.1

[58] Field of Search ..... 273/32 A, 32 F, 32 B, 273/33, 162 E, 202, 162 C, 32.5; 294/19.1

[56] References Cited

U.S. PATENT DOCUMENTS

| | | | |
|---|---|---|---|
| 683,244 | 9/1901 | W. K. et al. | 273/33 |
| 919,731 | 4/1909 | La May . | |
| 925,212 | 6/1909 | McConville | 294/19.1 |
| 2,609,198 | 9/1952 | Armstrong . | |
| 2,834,629 | 5/1958 | Williams . | |
| 2,943,856 | 7/1960 | Eimerman . | |
| 3,889,946 | 6/1975 | Setecka . | |
| 4,013,295 | 3/1977 | Boughman | 273/32.5 |
| 4,034,542 | 7/1977 | Loehr | 294/19.1 |
| 4,526,369 | 7/1985 | Phelps . | |
| 4,589,661 | 5/1986 | Attig . | |
| 4,693,473 | 9/1987 | Miller | 273/32 F |
| 4,819,938 | 4/1989 | Hill | 273/32.5 |

*Primary Examiner*—Theatrice Brown

[57] ABSTRACT

An apparatus having a wedge and wheel operated spring biased normally closed clamp at a first terminal end of a handle with the clamp openable and adapted for retrieving a golf ball and providing controllable mechanics for setting the golf ball on a captured tee a desired height above a ground level. The clamp can be operated by a levering control pivotally affixed externally adjacent a second terminal end of the handle.

7 Claims, 7 Drawing Sheets

GOLF BALL SETTER

BACKGROUND OF THE INVENTION

1. Field of the Invention:

This invention relates to handled devices having golf ball and tee setting mechanics at a lower terminal end. The present invention is particularly directed towards golf ball retrievers and golf ball setters having depth of tee setting gauging features and controls in the handle for retrieving a golf ball without the user required to stoop.

2. Description of the Prior Art:

Although some long handles and some cain length handles with golf ball holding ends for teeing golf balls are seen in part art patents and a few in the market place, none of the offerings seem to have had wide spread acceptance. The probable reason is that they are cumbersome to operate and not necessarily very effective. Examples of these devices are seen in the Armstron patent dated Sept. 2, 1952, U.S. Pat. No. 2,609,198, the Williams patent, U.S. Pat. No. 2,,834,629, dated May 13, 1958, and the patent issued July 5, 1960, to Eimerman, U.S. Pat. No. 2,943,856. Armstrong uses a tubular spring biased plunger inside a handle to push a tee holding a golf ball into the ground. The Williams device is a golf ball retriever having spring biased jaws which lock open and snap shut when a golf ball is pushed against a triggering ball rest. Eimerman shows a device which releases a held golf ball and tee when a plunger tip is pushed against the ground as the tee is inserted. A wire frame device fitted with a handle is shown as a golf ball positioning device in the Setecka patent issued June 17, 1975, U.S. Pat. No. 3,889,946. The Phillips device in U.S. Pat. No. 4,526,369, dated July 2, 1985 and the Attig apparatus, U.S. Pat. No. 4,589,661, issued May 20, 1986, both show clamping devices operated by a handle pull having a jaw which passes in under the ball.

In developing a spring biased clamping device useful for retrieving a golf ball and teeing a golf ball with the same device, other handled spring biased clamping devices must be considered. For example, a patent issued to F. B. La May on Apr. 27, 1909, U.S. Pat. No. 919,731, discloses a lifting device for retrieving shelf items, caned goods, etc. Versions of this retriever are still in use in many stores today. It illustrates a basic spring biased clamping device operational by an exterior control on a handle. Although the device would not be a very effective golf ball retriever or tee setter and the patent protection has long expired, it does illustrate an effective clamping arrangement which appears to have influenced later developments.

In any device useful for retrieving a golf ball or holding the golf ball and tee for setting the tee without requiring the golfer to stoop the device must have a handle of the proper length and mechanics for picking up and holding a golf ball releasably with the tee at the end. Controls handy to the golfer must be incorporated at the handle end of the a golf club length handle or rod and the rod should be of a design in decor with the golf clubs. An adjustable depth guide for setting the tee insert level according to the individual golfer's requirements should also be incorporated into the device.

SUMMARY OF THE INVENTION

Therefore, in practicing my invention I have provided a golf ball and tee setting device structured to provide the needed functions. My device is light weight, easy to handle and similar in size and style to a conventional golf club and is especially suited to people who cannot comfortably bend over frequently to set their golf tee and golf ball. Using the immediate invention, a golf ball can also be easily retrieved from under brush or in shallow water. The invention consists of an elongated hollow metal shaft having a golf ball grasping means affixed to one end and a handle and control lever for the grasping means affixed to the opposite end. The golf ball grasping means consists of two opposing jaws operable from the manual lever on the opposite end of the shaft by a linkage system housed within the hollow shaft. The distal ends of both jaws are bifurcated and adapted to retain the head of a golf tee when held in conjunction with the golf ball. This improved tee retainer holds the tee securely until inserted into the ground and is then easily released, unlike some of the past art devices where the tee becomes snagged in the holder. An adjustable depth gauge is also attached adjacent the jaws for presetting the depth of the tee into the ground.

Therefore, a major object of the invention is to provide a golf tee and golf ball setter which easily grasps a golf ball, and securely retains it and the tee until set into the ground.

Another object of the invention is to provide a golf tee and golf ball setter which prevents snagging of the tee on the holding device.

A further object of the invention is to provide a golf tee and golf ball setter which is compact and light weight, and can be easily carried within the golf bag along with the golf clubs.

Other novel features and advantages of my device will become apparent as the invention is hereinafter more fully described, illustrated and claimed.

DESCRIPTION OF THE PREFERRED EMBODIMENT

Figure 4:
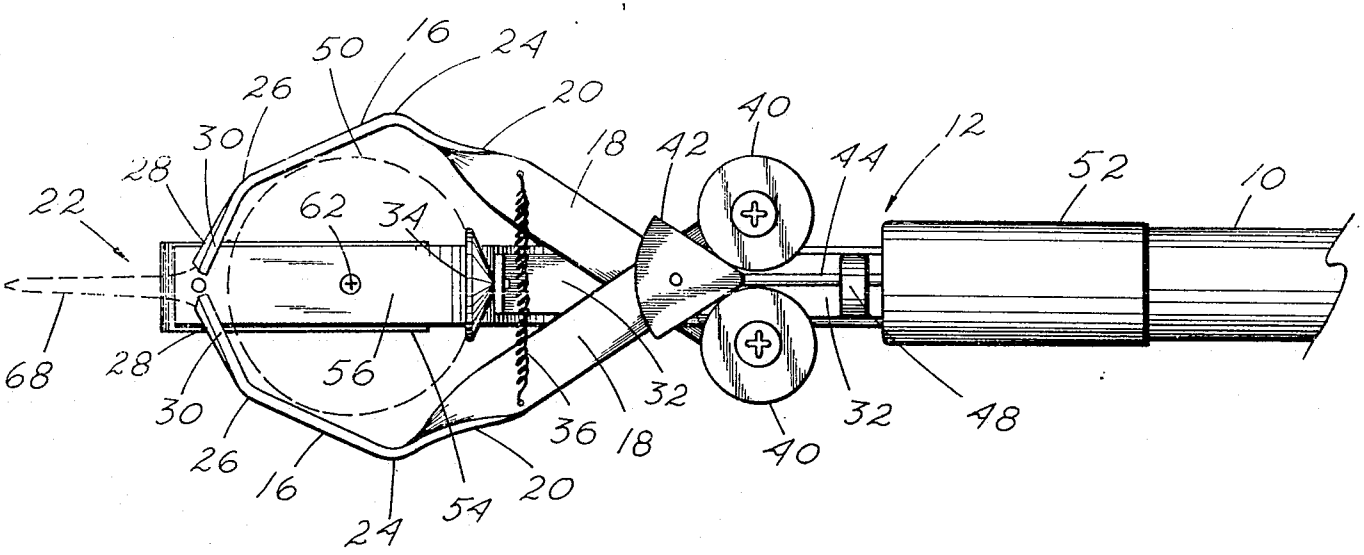
FIG. 4 is an enlarged front view of the jaw section from the opened side illustrating a golf ball and golf tee represented by a dotted outline positioned in the jaws ready for setting.
Figure 5:
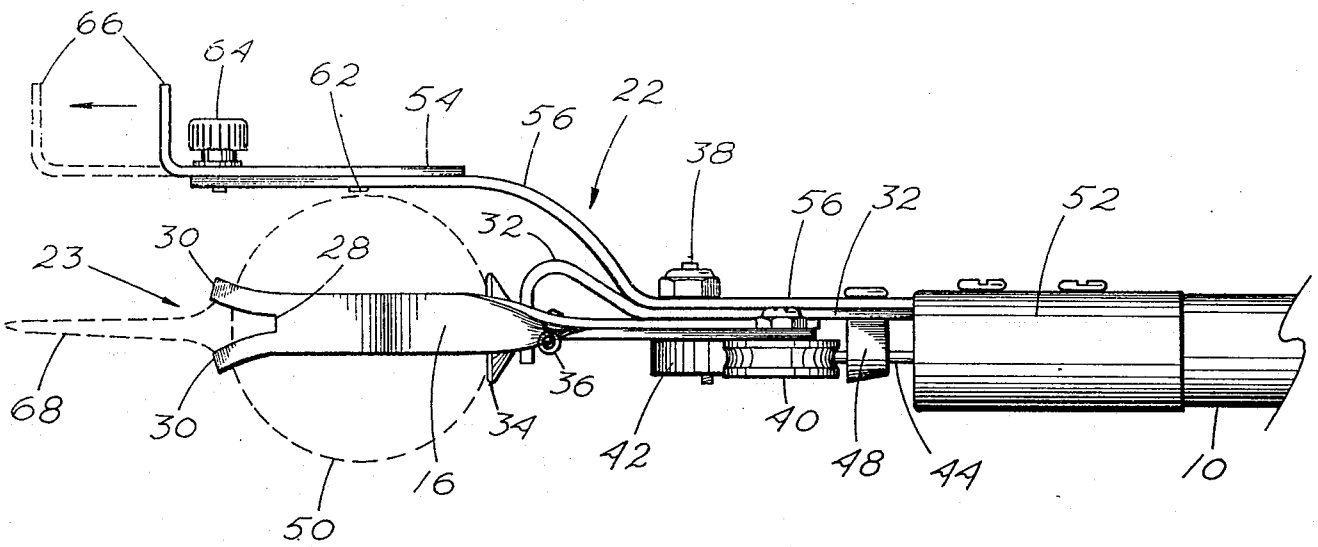
FIG. 5 is an enlarged side view of the lower shaft end and the jaw section. The adjustable tee depth gauge and movement of the tee foot is shown relative to the dotted outline of a entrapped golf ball and tee.
Figure 6:
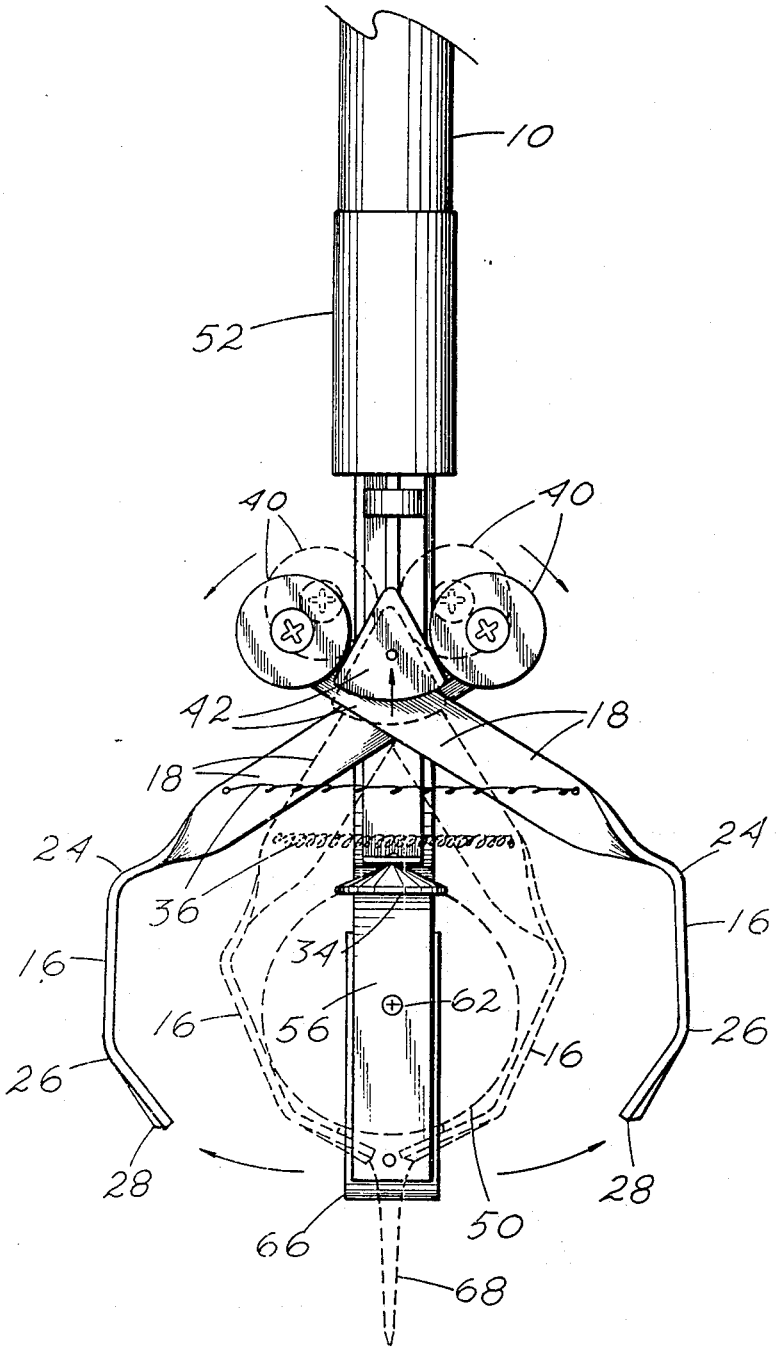
FIG. 6 is an enlarged front view of the jaw section illustrating upward movement of the center wedge forcing the pivotal wheels apart and opening the jaws.

Referring now to the drawings where the preferred embodiment of the invention is illustrated. The device is comprised of an elongated tubular shaft 10 sized somewhat larger diametrically than a conventional golf club shaft and approximately of the same length. See the FIG. 1 perspective illustration. Shaft 10 is hollow and has a first shaft end 12 and on oppositely disposed second shaft end 14. The first shaft end 12 is affixed with two opposing jaws 16 arranged as an openable clamp 22 with mechanics for operating clamp 22 and opening jaws 16. See FIG. 2 for more details. Each jaw 16 consists of an elongated flat metal band having a first flat straight end, jaw flat end 18, and an opposite second end, jaw grasping end 23, which has been twisted, twist 20, and is positioned perpendicular to jaw flat end 18. Each jaw 16 at jaw grasping end 23 is bent into two inward angles which actually form grasping end 23. One angle bend 24 is where twist 20 begins and the second, angle bend 26, is adjacent jaw grasping end 23. Jaw grasping end 23 is cut back in the center by a V-cut, V 28, and formed into two outwardly extending prongs 30. Both jaws 16 are pivotally affixed at pivotal attachment 38 to a thin elongated metal plate, jaw support member 32, which projects from first shaft end 12. Jaw support member 32 angles inward at the end between jaws 16 and is affixed on the underside between jaws 16 with ball cap 34. See FIG. 3. Ball cap 34 is conically formed to the shape of golf ball 50. The normally closed position of clamp 22 is provided by a biasing spring, spring 36, attached at each end to one member of jaws 16 just above twist 20 adjacently above ball cap 34. Spring 36 holds jaws 16 maintaining clamp 22 in a normally closed position until jaws 16 are manually pressured to open. After manual pressure is released, spring 36 pulls jaws 16 back to a closed position. Unique to the immediate invention is the pivotal mechanics of jaws 16 which provide easy and precise opening and closing of jaws 16. These mechanics are included in pivotal wheels 40 attached to the flat extending ends of jaw flat ends 18 above pivotal attachment 38 and a triangular wedge, wedge 42, which is attached to a pull rod, rod 44, protruding out the lower end of first shaft end 12. See the clamp 22 operational details of jaws 16 in FIG. 4, FIG. 5, and FIG. 6. Rod 44 extends up inside shaft 10 and attaches pivotally to a levering control, control lever 46, adjacent second shaft end 14 which is the upper handle end of the device. See FIG. 2. Rod retainer bracket 48 holds rod 44 in a fixed position relative to jaw support member 32 which aligns the pointed upper triangular end of wedge 42 between pivotal wheels 40. A protective covering, bumper covering 52, covers a lower section of shaft 10 extending somewhat over the edge of first shaft end 12. Second shaft end 14 has a similar short covering, hand guard covering 58. These coverings enhance the appearance of the device and protect the terminal ends from damage as well as providing a handle gripping end at hand guard covering 58. See FIG. 1 and FIG. 2 for full length details.

Figure 7:
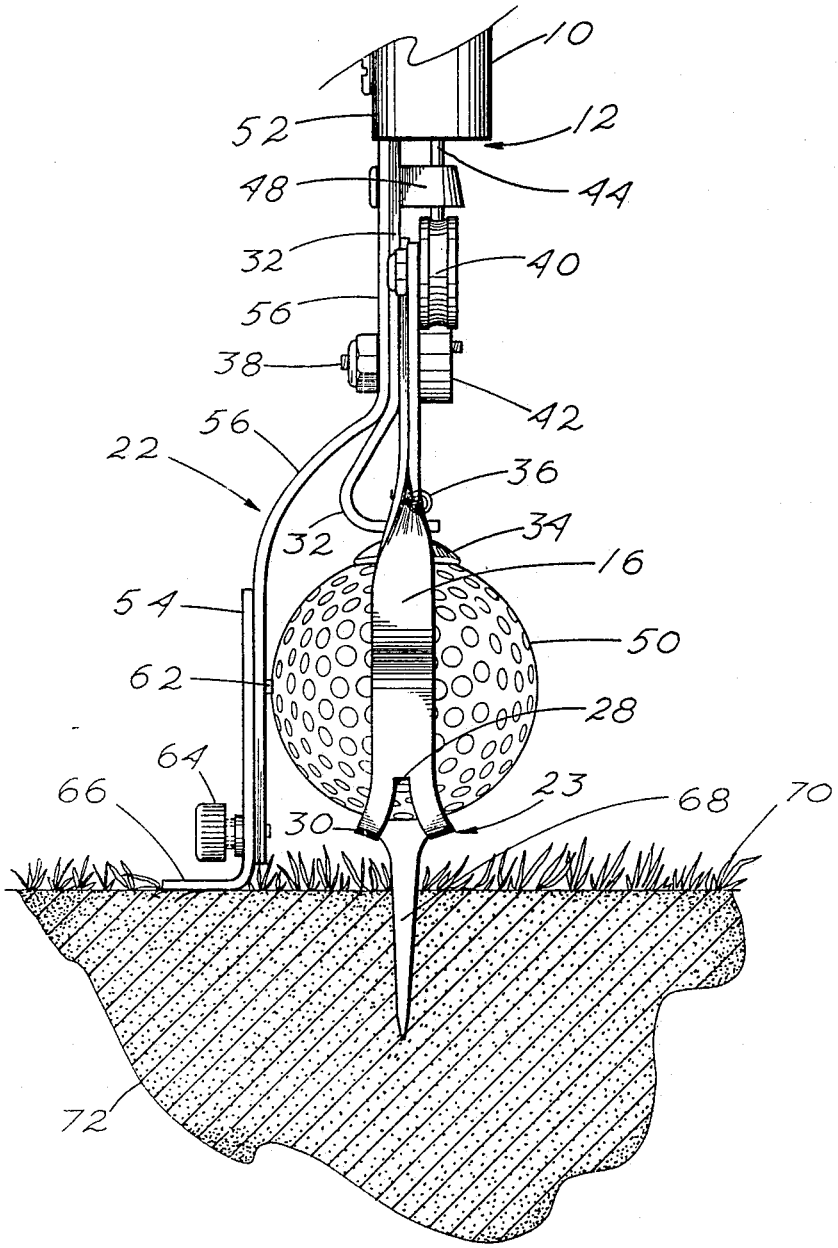
FIG. 7 is an enlarged side view of the golf ball setter according to the invention in use implanting the end of the tee in the ground with the tee depth gauge providing a preset positioning of the golf ball relative to the ground level and grass height.

To maintain golf ball 50 in the grip of jaws 16, a backing member is provided in the form of a short rectangular plate, ball support plate 56, affixed to jaw support member 32 and to pivotal attachment 38. Ball support plate 56 curves out from pivotal attachment 38 and forms a back support for golf ball 50 as a third leg in alignment with jaws 16. See FIG. 5 and FIG. 7. Ball support plate 56 also provides a supporting structure for adjustable tee implant gauge 54 along the back side of clamp 22. Tee implant gauge 54 is a short metal strap having longitudinal slots 60 opened through a section aligned with ball support plate 56 which can move slidably along a round tab 62 protruding from the back side of ball support plate 56. Movement of tee implant gauge 54 can be controlled and locked in a desired position by loosening and tightening knob screw 64. The lower free end of tee implant gauge 54 is right angled away from jaw grasping ends 23 and provides ground surface resting of adjustable gauge foot 66 for setting golf tee 68 a desired depth in ground 72 to position golf ball 50 at a desired height relative to the length of grass of turf 70. See operational details in FIG. 5 and FIG. 7.

Figure 1:
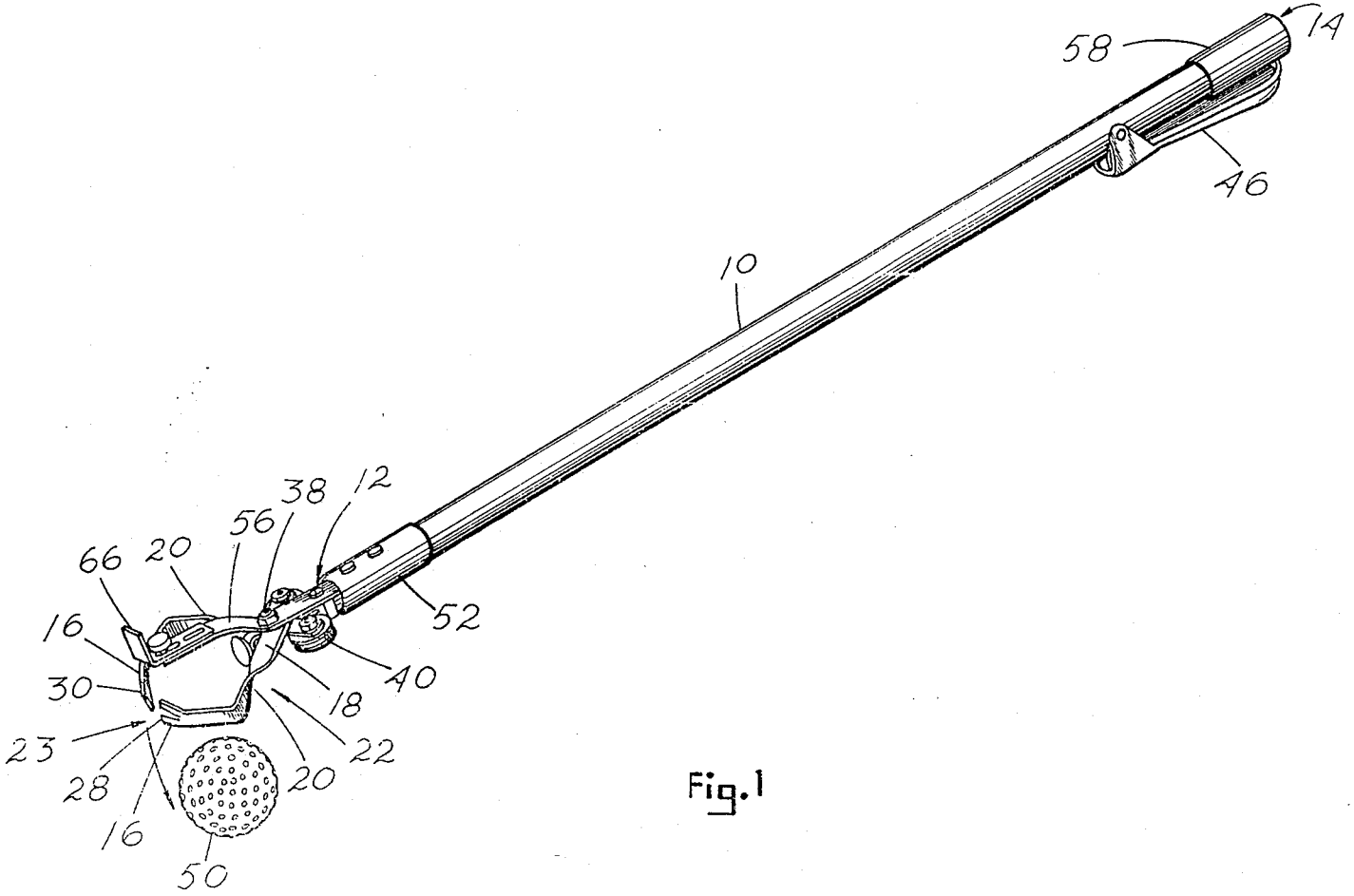
FIG. 1 is a perspective view the golf ball setter according to the invention as it would be used to retrieve a golf ball.
Figure 2:
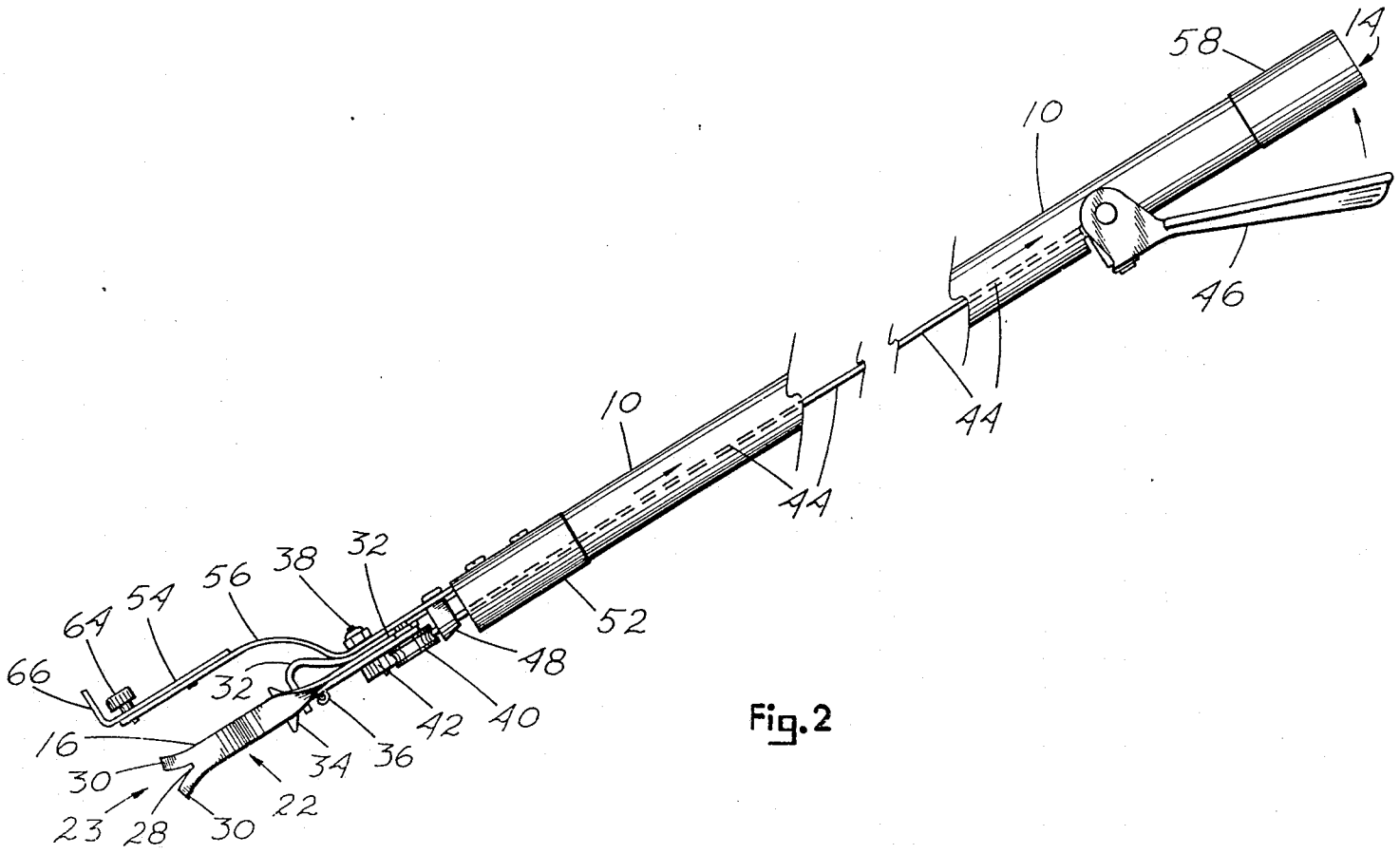
FIG. 2 is a segmented enlarged side view of the device illustrating the jaws, the internal linkage system, and the control lever.
Figure 3:
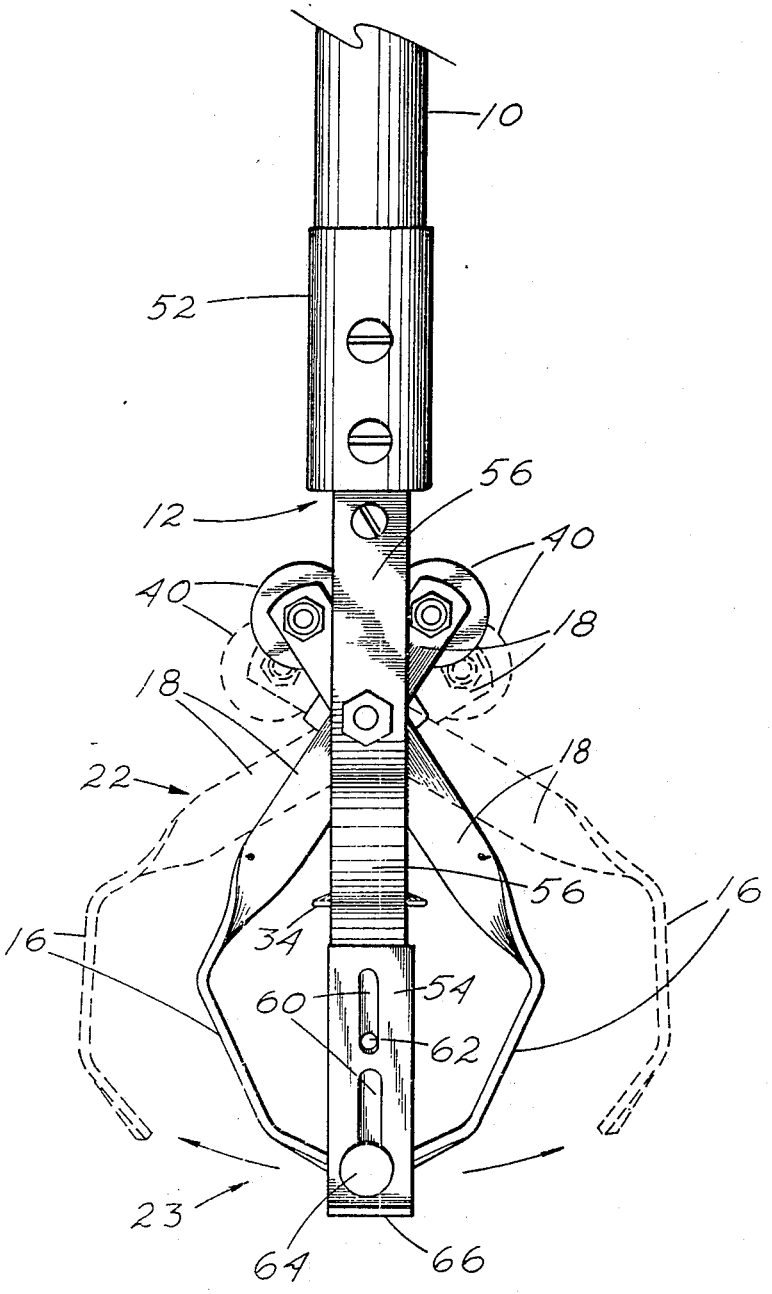
FIG. 3 is an enlarged rear view of the jaw section showing the tee height gauging structure and illustrating opened and closed positions of the opposing jaws.

As illustrated in FIG. 1, golf ball 50 can be retrieved from water or brush by pressing control lever 46 and partly opening jaws 16 of clamp 22 then scooping up golf ball 50. In FIG. 3, an operational back view of clamp 22 and in FIG. 6, an operational front view, mechanics of clamp 22 for opening jaws 16 are best shown. Jaws 16 open when control lever 46 is pressed pulling rod 44 upwards which causes wedge 42 to move up between pivotal wheels 40 spreading them and scissoring jaws 16 open. See FIG. 2 and FIG. 6. When pressure is released on control lever 46, spring 36 pulls jaws 16 back together causing pivotal wheels 40 to move in and press wedge 42 back to a lower rest position. For simply picking golf ball 50 up from the ground, jaws 16 are opened and positioned around golf ball 50 which can then be picked up by releasing control lever 46 and allowing jaws 16 to be pulled closed by spring 36. Golf ball 50 is retained in jaws 16 by ball support plate 56 and spring 36 holding jaws 16 together. Shaft 10, being about the same length as a golf club shaft, allows reaching for golf ball 50 at least as far as a golf club would reach.

For golf ball and tee setting, shaft 10 can be turned over with jaws 16 of clamp 22 in an upward position. Jaws 16 can be opened by pressing control lever 46 and golf ball 50 with gold tee 68 held to the end of it can be placed between jaws 16 against ball support plate 56 resting in ball cap 34. The tee shaft of golf tee 68 passes through V 28, the V-opening formed in the jaw grasping end 23 of jaws 16 between prongs 30. Jaws 16 are then eased down on golf ball 50 and golf tee 68 with prongs 30 resting on the bottom of the cup edge of golf tee 68. With tee implant gauge 54 set to place golf ball 50 at a desired height above ground level, shaft 10 is turned around and vertically pushed downwards forcing golf tee 68 into the ground until gauge foot 66 contacts the ground surface. Control lever 46 is squeezed or pressed and jaws 16 are scissored open as wedge 42 is pulled upwards against pivotal wheels 40. The wedge 42 and pivotal wheel 40 arrangement provides a smooth precision opening of jaws 16 without the danger of a jerky opening dislodging golf ball 50 from golf tee 68. See FIG. 7 for illustration. After placement of golf ball 50 on golf tee 68 in ground 72, shaft 10 is moved backwards held in a vertical position releasing golf ball 50 out the front opening of clamp 22.

The golf ball setter according to the immediate invention as described in the specification and illustrated in the drawings is presented as a precision device in a useful embodiment which obviously could be changed by persons skilled in the art to accomplish a similar result. Therefore, it is to be understood that the heretofore presentation is for descriptive and illustrative purposes only and is not intended to limit modifications to the invention which fall within the intended scope of the appended claims.

What I claimed is:

1. A golf ball and tee setter and retriever apparatus comprising, and elongated handle having first and second ends, a pair of jaw members, each said jaw member having a straight portion at one end thereof and an arcuate portion at the other end thereof, support means connected to said first end of said handle, pivot means connecting said jaw members to said support means intermediate the end of said straight portion such that said straight portions cross each other and said arcuate portions face each other to form a ball grasping pocket therebetween, wheel means attached to said straight portions remote from said pivot means and said arcuate portions, means normally biasing said wheel means towards each other and said arcuate towards each other and said arcuate portions towards each other to form said ball grasping pocket, connector ends, said connector means extending from beyond said handle first end to said handle second end and being longitudinally movable along said handle, wedge means attached to said connector means first end, control means attached to said handle second end, said connector means second end being attached to said control means, said wedge means being positioned between said wheel means such that upon actuation of said control means by a user said wedge means will move towards said handle means and said wheel means along with said arcuate portions will be forced apart for releasing or grasping a golf ball, cradle means attached to said support means for cradling a golf ball from above when said ball is placed between said arcuate portions, means on said arcuate portions for grasping a golf tee below a golf ball held by said jaw members such that when the tee is pushed into the ground and said jaw members are forced apart by said wedge means the ball will be placed upon the tee, gauge means attached to said support means for centering a golf ball between said jaw members and beneath said candle means, and for placing a golf ball on a tee a desire height above a ground surface.

2. A golf ball and tee setter and retriever apparatus as defined in claim 14 wherein, said handle is a hollow tubular member and said connector means extend along the longitudinal interior of said tubular member.

3. A golf ball and tee setter and retriever apparatus as defined in claim 1 wherein, said handle is a hollow elongated lever having one of its ends pivotally attached to adjacent said handle second end and a portion thereof connected to said second end of said connector means.

4. A golf ball and tee setter and retriever apparatus as defined in claim 1 wherein, said wedge means is triangular and said means for cradling is cup shaped.

5. A golf ball and tee setter and retriever as defined in claim 1 wherein, said mean on said arcuate portions for grasping a tee is a V-shaped notch in said arcuate portion and said biasing means is a tension spring extending between and attached to said jaw members.

6. A golf ball and tee setter and retriever as defined in claim 1 wherein, said support means is an elongated plate having a curved end, said means cradling being attached to said curved end.

7. A golf ball and tee setter and retiever apparatus as defined in claim 6 wherein, said guage means is adjustably attached to said support means.

* * * * *